US008520803B2

(12) United States Patent
Behling

(10) Patent No.: US 8,520,803 B2
(45) Date of Patent: Aug. 27, 2013

(54) MULTI-SEGMENT ANODE TARGET FOR AN X-RAY TUBE OF THE ROTARY ANODE TYPE WITH EACH ANODE DISK SEGMENT HAVING ITS OWN ANODE INCLINATION ANGLE WITH RESPECT TO A PLANE NORMAL TO THE ROTATIONAL AXIS OF THE ROTARY ANODE AND X-RAY TUBE COMPRISING A ROTARY ANODE WITH SUCH A MULTI-SEGMENT ANODE TARGET

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 278 days.

(21) Appl. No.: 13/058,341

(22) PCT Filed: Aug. 6, 2009

(86) PCT No.: PCT/IB2009/053448

§ 371 (c)(1), (2), (4) Date: Feb. 10, 2011

(87) PCT Pub. No.: WO2010/018502

PCT Pub. Date: Feb. 18, 2010

(65) Prior Publication Data

US 2011/0135066 A1 Jun. 9, 2011

(30) Foreign Application Priority Data

Aug. 14, 2008 (EP) ..... 08105043

(51) Int. Cl.
*H01J 35/08* (2006.01)

(52) U.S. Cl.
USPC ..... 378/124; 378/143; 378/144

(58) Field of Classification Search
USPC ..... 378/143, 144, 119, 121, 124
See application file for complete search history.

(56) References Cited

U.S. PATENT DOCUMENTS

| | | | | |
|---|---|---|---|---|
| 3,414,754 | A | 12/1968 | Elsas | 378/144 |
| 5,615,279 | A * | 3/1997 | Yoshioka et al. | 382/131 |
| 6,560,315 | B1 | 5/2003 | Price et al. | 378/144 |
| 2005/0281379 | A1 | 12/2005 | Qiu et al. | 378/122 |
| 2007/0153979 | A1 | 7/2007 | Baumann et al. | 378/138 |

FOREIGN PATENT DOCUMENTS

| | | |
|---|---|---|
| DE | 1062827 | 8/1959 |
| DE | 2203403 | 8/1973 |
| DE | 2932042 | 2/1981 |
| DE | 19639920 | 8/1999 |
| FR | 2555359 | 4/1985 |
| JP | 2004236752 | 8/2004 |
| JP | 2007073297 | 3/2007 |

* cited by examiner

*Primary Examiner* — Courtney Thomas

(57) ABSTRACT

The present invention refers to X-ray tubes for use in imaging applications with an improved power rating and more particularly, to a multi-segment anode target (102') for an X-ray based scanner system using an X-ray tube of the rotary anode type; the X-ray tube including a rotatably supported essentially disk-shaped rotary anode (102) with an anode target (102') for emitting X-radiation when being exposed to an electron beam (105*a*) incident on a surface of the anode target (102'), wherein the rotary anode disk (102) is divided into at least two anode disk segments (102*a* and 102*b*) having a conical surface inclined by a distinct acute angle (α) with respect to a plane normal to the rotational axis (103) of the rotary anode disk (102), thus having its own focal track width. An advantage of the invention consists in an enhanced image quality compared to conventional rotary anodes as known from the prior art.

20 Claims, 5 Drawing Sheets

MULTI-SEGMENT ANODE TARGET FOR AN X-RAY TUBE OF THE ROTARY ANODE TYPE WITH EACH ANODE DISK SEGMENT HAVING ITS OWN ANODE INCLINATION ANGLE WITH RESPECT TO A PLANE NORMAL TO THE ROTATIONAL AXIS OF THE ROTARY ANODE AND X-RAY TUBE COMPRISING A ROTARY ANODE WITH SUCH A MULTI-SEGMENT ANODE TARGET

The present invention refers to X-ray tubes for use in imaging applications with an improved power rating and, more particularly, to a multi-segment anode target for an X-ray based scanner system using an X-ray source of the rotary anode type, wherein said anode target is divided into two or more anode disk segments with each of said anode disk segments having its own inclination angle with respect to a plane normal to the rotational axis of the rotary anode. An electron beam incident on the inclined surface of the rotary anode is pulsed such that the electron beam is in a switched on state when the anode disk segment with the smaller inclination angle passes said electron beam. Vice versa, said electron beam is in a switched off state when the anode disk segment with the larger inclination angle passes said electron beam.

BACKGROUND OF THE INVENTION

Conventional high power X-ray tubes typically comprise an evacuated chamber which holds a cathode filament through which a heating or filament current is passed. A high voltage potential, usually in the order between 100 kV and 200 kV, is applied between the cathode and an anode which is also located within the evacuated chamber. This voltage potential causes a tube current or beam of electrons to flow from the cathode to the anode through the evacuated region in the interior of the evacuated chamber. The electron beam then impinges on a small area or focal spot of the anode with sufficient energy to generate X-rays. The anode is typically made of metals such as tungsten, molybdenum, palladium, silver or copper. When the electrons are reaching the anode target, most of their energy is converted into thermal energy. A small portion of the energy is transformed into X-ray photons which are then radiated from the anode target while forming an X-ray beam.

Today, one of the most important power limiting factor of high power X-ray sources is the melting temperature of their anode material. At the same time, a small focal spot is required for high spatial resolution of the imaging system, which leads to very high energy densities at the focal spot. Unfortunately, most of the power which is applied to such an X-ray source is converted into heat. Conversion efficiency from electron beam power to X-ray power is at maximum between about 1% and 2%, but in many cases even lower. Consequently, the anode of a high power X-ray source carries an extreme heat load, especially within the focus (an area in the range of about a few square millimeters), which would lead to the destruction of the tube if no special measures of heat management are taken. Efficient heat dissipation thus represents one of the greatest challenges faced in the development of current high power X-ray sources. Commonly used thermal management techniques for X-ray anodes include:

- using materials that are able to resist very high temperatures,
- using materials that are able to store a large amount of heat, as it is difficult to transport the heat out of the vacuum tube,

- enlarging the thermally effective focal spot area without enlarging the optical focus by using a small angle of the anode, and
- enlarging the thermally effective focal spot area by rotating the anode.

Except for high power X-ray sources with a large cooling capacity, using X-ray sources with a moving target (e.g. a rotating anode) is very effective. Compared to stationary anodes, X-ray sources of the rotary-anode type offer the advantage of quickly distributing the thermal energy that is generated in the focal spot such that damaging of the anode material (e.g. melting or cracking) is avoided. This permits an increase in power for short scan times which, due to wider detector coverage, went down in modern CT systems from typically 30 seconds to 3 seconds. The higher the velocity of the focal track with respect to the electron beam, the shorter the time during which the electron beam deposits its power into the same small volume of material and thus the lower the resulting peak temperature.

High focal track velocity is accomplished by designing the anode as a rotating disk with a large radius (e.g. 10 cm) and rotating this disk at a high frequency (e.g. at more than 150 Hz). However, as the anode is now rotating in a vacuum, the transfer of thermal energy to the outside of the tube envelope depends largely on radiation, which is not as effective as the liquid cooling used in stationary anodes. Rotating anodes are thus designed for high heat storage capacity and for good radiation exchange between anode and tube envelope. Another difficulty associated with rotary anodes is the operation of a bearing system under vacuum and the protection of this system against the destructive forces of the anode's high temperatures. In the early days of rotary anode X-ray sources, limited heat storage capacity of the anode was the main hindrance to high tube performance. This has changed with the introduction of new technologies. For example, graphite blocks brazed to the anode may be foreseen which dramatically increase heat storage capacity and heat dissipation, liquid anode bearing systems (sliding bearings) may provide heat conductivity to a surrounding cooling oil, and providing rotating envelope tubes allows direct liquid cooling for the backside of the rotary anode.

If X-ray imaging systems are used to depict fast moving objects, high-speed image generation is typically required so as to avoid occurrence of motion artefacts. An example would be a CT scan of the human myocard (cardiac CT): In this case, it would be desirable to perform a full CT scan of the heart with high resolution and high coverage within less than e.g. 100 ms, which means within the time span during a heart cycle while the myocard is at rest. High-speed image generation, however, requires high peak power performance of the respective X-ray source.

SUMMARY OF THE INVENTION

It may thus be an object of the present invention to provide a novel rotary anode design concept which helps to optimize the achievable power rating of conventional X-ray tubes of the rotary anode type dependent on the angular size of a desired field of view for visualizing a region of interest to be examined.

In view of this object, a first exemplary embodiment of the present invention is directed to an X-ray tube of the rotary anode type which comprises a rotatably supported essentially disk-shaped rotary anode with an anode target for emitting X-radiation when being exposed to an electron beam incident on a surface of said anode target. As proposed by the present invention, said rotary anode disk is divided into at least two anode disk segments with each of said anode disk segments having a conical surface inclined by a distinct acute angle (herein referred to as "inclination angle" or "anode angle") with respect to a plane normal to the rotational axis of said rotary anode disk and thus having its own focal track width. Preferably, it may e.g. be foreseen that the rotary anode disk is divided into a number of anode disk segments of equal angular size.

When being applied in the scope of X-ray or CT imaging applications with fast moving objects to be visualized (such as e.g. the myocard), it is necessary to pulse the X-ray beam emitted by an X-ray tube of the rotary anode type so as to freeze motions of this object. Thereby, pulse duration $T_p$ (desired: $T_p$=3 . . . 7 ms) is usually shorter than half a revolution period $T_r$ of the rotary anode, the latter being typically in the range of 15 ms. The X-ray tube according to the present invention may therefore comprise a control unit for pulsing the electron beam such that the electron beam has a duty cycle which takes on its switched on state only when the electron beam impinges on a selectable anode disk segment with an inclination angle from a given angular range or on a anyone from a selectable set of these anode disk segments. In other words, the electron beam is only active when it passes a selected anode segment. For synchronizing the phase of anode rotation with a pulse sequence needed for pulsing the electron beam, a synchronization means may be provided.

According to the present invention, the above-described X-ray tube may additionally comprise at least one focusing unit for focusing the electron beam on the position of a focal spot on the anode target of said X-ray tube's rotary anode disk as well as a focusing control unit for adjusting the focusing of the focal spot such that deviations in the focal spot size relative to a given nominal focal spot size are compensated.

Furthermore, said X-ray tube may comprise at least one deflection unit for generating an electric and/or magnetic field deflecting the electron beam in radial direction of the rotary anode disk and a deflection control unit for adjusting the strength and/or algebraic sign of the electric and/or magnetic field such that deviations in the focal spot position relative to a nominal focal spot position on a circular focal track of a given width, said width depending on the inclination angle of the respective anode disk segment, are compensated.

It may advantageously be provided that said control unit is adapted to pulse the electron beam such that, depending on the size of a region of interest to be visualized, only the anode disk segment with the smallest possible inclination angle needed for completely irradiating said region of interest (and thus the anode disk segment yielding the highest possible power rating) is exposed to said electron beam.

Controlling the electron beam's pulse sequence thus allows to select the optimal segment of the focal spot track with the smallest possible inclination angle dependent on the angular size of a desired field of view and helps to achieve a maximum photon flux (thus yielding a maximum brightness of the focal spot) as well as a maximized power rating. An advantage of the invention consists in an enhanced image quality compared to conventional rotary anodes as known from the prior art.

A second exemplary embodiment of the present invention relates to an X-ray tube of the rotary anode type which comprises a rotatably supported multi-target anode for emitting X-radiation when being exposed to an electron beam incident on a surface of a respective one from a plurality of distinct anode targets. According to this embodiment, said multi-target anode has a geometrical form which is given by a solid of revolution of a multi-segment structure comprising a number of conical anode segments inclined by distinct inclination angles with respect to a plane normal to the rotational axis of said rotary anode such that each anode target has its own focal track width and emits a fan X-ray beam with a field of view of its own size as given by the own angle of inclination of the conical anode segment and the opening angle of said X-ray beam.

Similar to said first exemplary embodiment, said X-ray tube may comprise at least one focusing unit for focusing the electron beam on the position of a focal spot on an anode target of said X-ray tube's rotary multi-target anode and a focusing control unit for adjusting the focusing of the focal spot such that deviations in the focal spot size relative to a given nominal focal spot size are compensated.

In addition to that, at least one deflection unit for generating an electric and/or magnetic field deflecting the electron beam in radial direction of the rotary multi-target anode may be provided as well as a deflection control unit for adjusting the strength and/or algebraic sign of the electric and/or magnetic field such that deviations in the focal spot position relative to a nominal focal spot position on a circular focal track of a given width, said width depending on the inclination angle of the respective anode segment, are compensated. The at least one focusing unit and the at least one deflection unit may thereby be realized as a combined multi-pole focusing and deflection electrode system and/or as a combined multi-pole focusing and deflection coil or magnet system, respectively.

A third exemplary embodiment of the present invention refers to an X-ray scanner system which comprises an X-ray tube of the rotary anode type as described above with reference to said first or second exemplary embodiment.

BRIEF DESCRIPTION OF THE DRAWINGS

These and other advantageous aspects of the invention will be elucidated by way of example with respect to the embodiments described hereinafter and with respect to the accompanying drawings. Therein.

DETAILED DESCRIPTION OF THE PRESENT INVENTION

In the following, an X-ray tube's rotary anode target according to an exemplary embodiment of the present invention will be explained in more detail with respect to special refinements and referring to the accompanying drawings.

Figure 1:
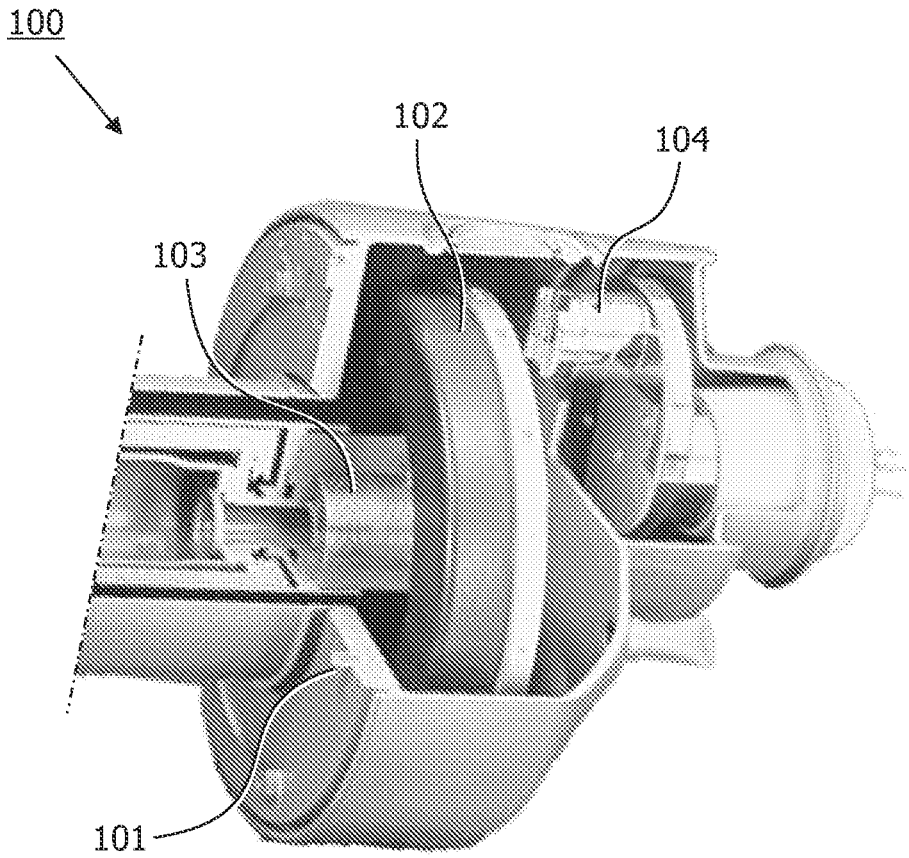
FIG. 1 shows a three-dimensional view of a conventional rotary anode based X-ray tube as known from the prior art.

The focal spot of an X-ray tube's anode emits X-radiation into a half sphere around the anode. As can be taken from FIG. 1, which shows a three-dimensional view of a conventional X-ray tube of the rotary anode type as known from the prior art with a rotationally supported anode fixedly attached to a rotary shaft 103, an X-ray beam which is emitted by the anode target of the rotary anode 102 when being exposed to an electron beam emitted by a cathode 104 may be limited by anode shadow, the radiation port of the X-ray tube, the radiation port of the tube housing 101 and by the blades of an additional aperture.

Figure 2:
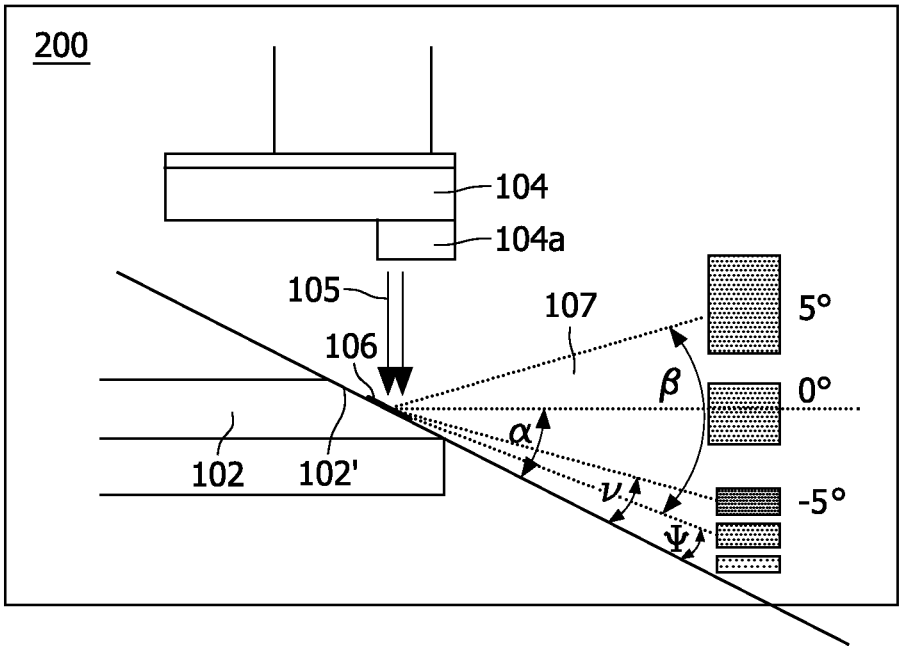
FIG. 2 shows a schematic diagram which illustrates the impact of the anode inclination angle on the angular radiation field size of an X-ray beam emitted by the rotary anode when being exposed to an electron beam incident on an anode target's focal spot on an X-radiation emitting surface of said anode inclined with respect to a plane normal to the direction of the incident electron beam, FIG. 3 contains two schematic diagrams which illustrate the impact of the rotary anode's inclination angle on the angular size of the obtained field of view, the width of the physical focal track and the achievable power rating.

The impact of the anode inclination angle on the radiation field of an emitted X-ray beam can be derived from FIG. 2. As shown in this figure, the X-ray optical focus spot 106 appears brighter for decreasing view angle $\nu$. Therefore, view angle $\nu$ and inclination angle $\alpha$ should be minimal. Penumbra and beam hardening effects restrict the useable radiation field angle $\beta$ to a minimum angle of 1° and a "reserve" angle $\psi$ of 5°. The ratio of thermal loadability and brightness of an X-ray tube's focal spot is optimal for a minimum inclination angle $\alpha$, which is due to the fact that thermal loadability and brightness are indirect proportional to the inclination angle. For a symmetric radiation field with an angular range as given by cone-beam angle $\beta$ of the obtained field of view, inclination angle $\alpha$ has to be designed according to the formula $\alpha=\beta/2+\psi$.

Figure 3:
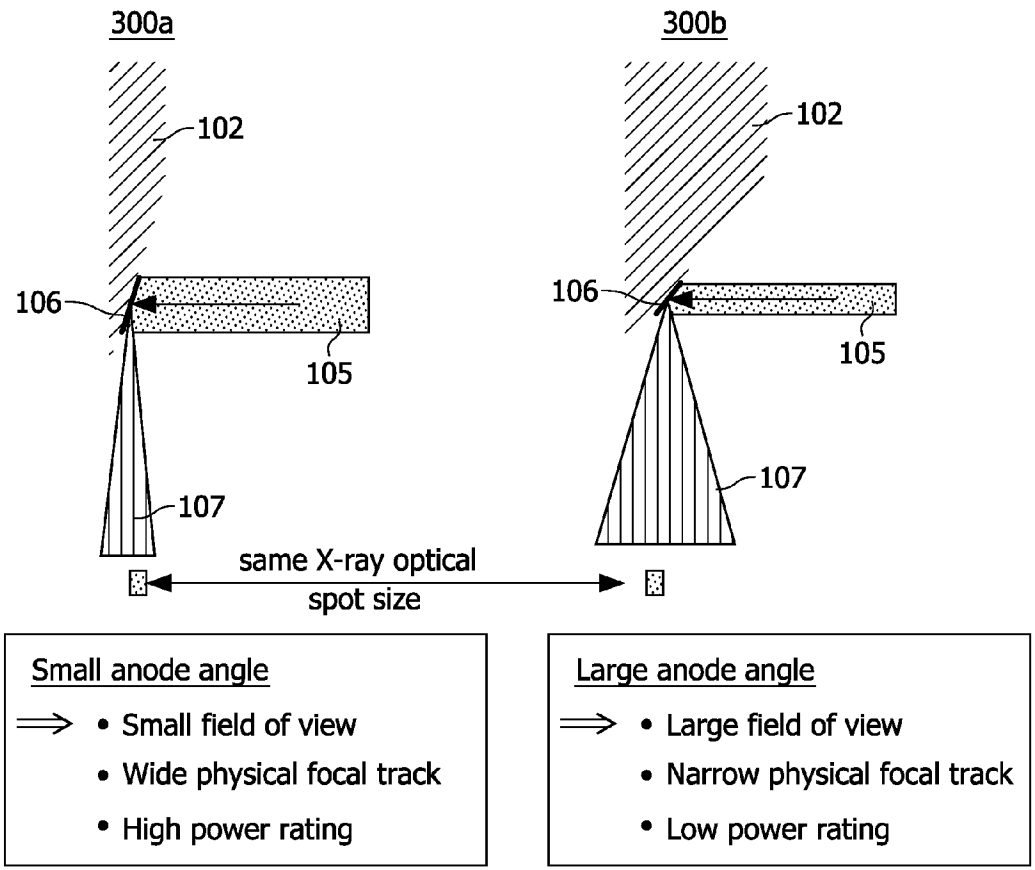

The impact of the anode's inclination angle $\alpha$ on the angular size $\beta$ of the obtained field of view, the width of the physical focal track and the achievable power rating can be derived from the two illustrative diagrams 300*a* and 300*b* as depicted in FIG. 3. Whereas a small inclination angle $\alpha$ leads to a small field of view, a wide physical focal track and a high power rating, a large inclination angle $\alpha$ has reverse impacts on the aforementioned parameters. The X-ray optical focal spot thus appears brighter for decreasing view angle $\nu$, which is due to the fact that the focal spot's brightness is indirectly proportional to the view angle. The ratio of thermal loadability and brightness of an X-ray tube's focal spot is thus optimal for a minimal anode inclination angle $\alpha$. For this reason, $\alpha$ and $\nu$ should be as small as possible. However, in current X-ray sources of the rotary-anode type that make use of multi-target configurations with different view angles, the anode inclination angle is not always optimal. A well-known prior-art solution is to tilt the tube or parts thereof, but in this case additional mechanical components for enabling such a tilting movement are needed.

Figure 4:
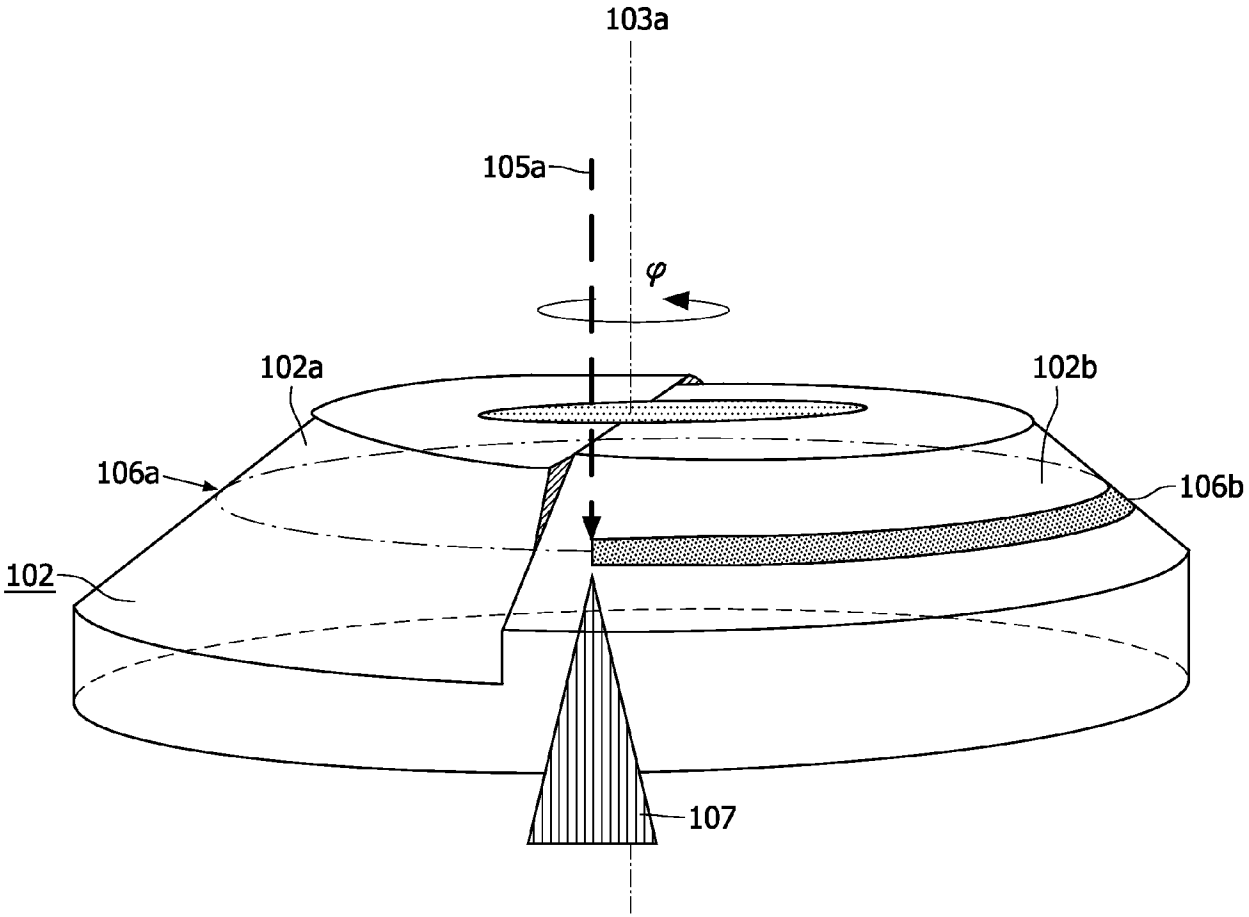
FIG. 4 shows a rotary anode of an X-ray source according to the first exemplary embodiment of the present invention, said rotary anode being divided into two or more anode disk segments with each of said anode disk segments having its own inclination angle with respect to a plane normal to the rotational axis of the rotary anode.

FIG. 4 shows a rotary anode 102 of an X-ray source according to the first exemplary embodiment of the present invention divided into two or more anode disk segments 102*a* and 102*b*, wherein each of said anode disk segments has its own inclination angle with respect to a plane normal to the rotational axis 103*a* of the rotary anode. An electron beam 105*a* incident on the inclined surface of the rotary anode is pulsed such that the electron beam is in a switched on state when the anode disk segment with the smaller inclination angle (i.e., anode disk segment 102*b*) passes said electron beam. Vice versa, said electron beam is in a switched off state when the anode disk segment with the larger inclination angle (i.e., anode disk segment 102*a*) passes said electron beam. The bold circular stripe segment on the inclined anode surface of anode target 102' thereby symbolizes the heated area on the focal track 106*b* of said anode.

Figure 5:
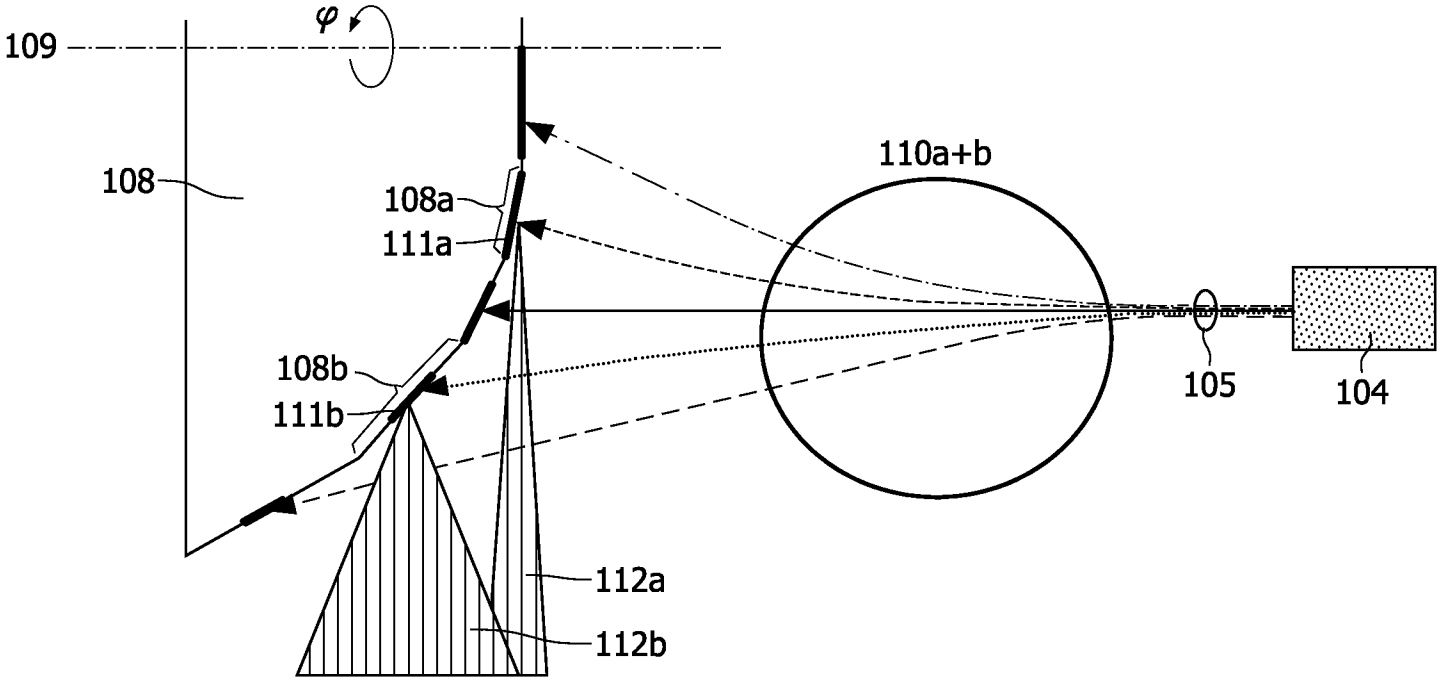
FIG. 5 shows a rotary multi-target anode of an X-ray source according to the second exemplary embodiment of the present invention, said rotary anode having a geometrical form which is given by a solid of revolution of a multi-segment structure comprising a number of conical anode segments inclined by distinct inclination angles with respect to a plane normal to the rotational axis of said rotary anode.

A rotationally supported multi-target anode 108 of an X-ray source according to the above-described second exemplary embodiment of the present invention with said rotary anode having a geometrical form which is given by a solid of revolution of a multi-segment structure comprising a number of conical anode segments inclined by distinct inclination angles with respect to a plane normal to the rotational axis of said rotary anode is shown in FIG. 5. By using such a system configuration, it can be provided that each anode target (in FIG. 5 exemplarily demonstrated for two anode targets 108*a* and 108*b* on the surfaces of distinct anode segments) has its own focal track width (in FIG. 5 referred to as 111*a* or 111*b*, respectively) and emits a fan X-ray beam with a field of view of its own size as given by the own angle of inclination of the conical anode segment and the opening angle of said X-ray beam (indicated by reference numbers 112*a* and 112*b*, respectively). For focusing the electron beam 105 emitted by a cathode 104 on the position of a focal spot (e.g. on the position of anyone from focal spots 111*a* or 111*b*) on an anode target (e.g. anode target 108*a* or 108*b*) of said X-ray tube's rotary multi-target anode 108, a focusing unit 110*a* is used. A focusing control unit which controls the operation said focusing unit 110*a* serves for adjusting the focusing of the focal spot (111*a* or 111*b*) such that deviations in the focal spot size relative to a given nominal focal spot size are compensated. The depicted system configuration may further comprise a deflection unit 110*b* for generating an electric and/or magnetic field deflecting the electron beam 105 in radial direction of the rotary multi-target anode 108. A deflection control unit which controls the operation of said deflection unit 110*b* is used for adjusting the strength and/or algebraic sign of the electric and/or magnetic field such that deviations in the focal spot position relative to a nominal focal spot position on a circular focal track of a given width, said width depending on the inclination angle of the respective anode segment, are compensated. The at least one focusing unit 110*a* and the at least one deflection unit 110*b* may thereby be realized as a combined multi-pole focusing and deflection electrode system and/or as a combined multi-pole focusing and deflection coil or magnet system (such as e.g. a dipole or quadrupole magnet), respectively. In this way, the physical focal track width is adjusted to a required optical focal spot size projected into the projection plane of an acquired 2D projection image.

When using a focusing unit as described above, a focal spot's length and width can be independently adjusted in a continuous manner. The above-described system configuration further allows to freely adjust the radial position of the focal spot by means of said deflection unit, which is practically impossible with the electrostatic focusing elements as employed in the prior art.

APPLICATIONS OF THE PRESENT INVENTION

The present invention can be employed in any field of X-ray imaging application which is based on X-ray scanner systems using X-ray tubes of the rotary anode type, such as e.g. in the scope of tomosynthesis, X-ray or CT applications. The invention may especially be used in those application scenarios where fast acquisition of images with high peak power is required, such as e.g. in the field of X-ray based material inspection or in the field of medical imaging, especially in cardiac CT or other high performance X-ray imaging applications for acquiring image data of fast moving objects (such as e.g. the myocard). Although the herein proposed X-ray scanner apparatus is described as belonging to a medical setting, it is contemplated that the benefits of the present invention may also accrue to non-medical imaging systems such as those systems typically employed in an industrial or transportation setting, such as, for example, but not limited to, baggage scanning systems as used on an airport or any other kind of transportation center.

While the present invention has been illustrated and described in detail in the drawings and in the foregoing description, such illustration and description are to be considered illustrative or exemplary and not restrictive, which means that the invention is not limited to the disclosed embodiments. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Furthermore, it is to be noted that any reference signs in the claims should not be construed as limiting the scope of the invention.

TABLE OF USED REFERENCE SIGNS

100 three-dimensional view of a conventional rotary anode based X-ray tube as known from the prior art

101 evacuated housing of X-ray tube 100

102 rotary anode disk according to the first exemplary embodiment of the present invention, divided into at least two anode disk segments (102*a* and 102*b*) with each of said anode disk segments having a conical surface inclined by a distinct acute angle α with respect to a plane normal to the rotational axis 103*a* of said rotary anode disk

102' X-radiation emitting surface of rotary anode disk 102 (herein also referred to as "anode target")

102*a* first anode disk segment having a first inclination angle with respect to a plane normal to the rotational axis 103*a* of rotary anode disk 102 (here: the anode disk segment wits the larger inclination angle of the two depicted anode disk segments 102*a* and 102*b*)

102*b* second anode disk segment having a second inclination angle with respect to the plane normal to the rotational axis 103*a* of rotary anode disk 102 (here: the anode disk segment with the smaller inclination angle of the aforementioned two depicted anode disk segments 102*a* and 102*b*)

103 rotary shaft to which the rotationally supported rotary anode disk 102 is fixedly attached

103*a* rotational axis of rotary anode disk 102

104 cathode for emitting an electron beam 105 to which the anode target 102' is exposed

104*a* combined focusing and deflection unit for focusing the electron beam 105*a* on the position of a focal spot 106 on the anode target 102' of said X-ray tube's rotary anode disk 106 and/or generating an electric and/or magnetic field for deflecting the electron beam 105*a* in radial direction of the rotary anode disk 102

105 electron beam emitted by cathode 104

105*a* pulsed sequence of the electron beam 105 emitted by cathode 104

106 focal spot position on the anode target 102' of said X-ray tube's rotary anode disk 102

106*a* not existing focal track on the anode disk segment 102*a* with the larger inclination angle of the two depicted anode disk segments 102*a* and 102*b*

106*b* circular arc shaped focal track on the anode disk segment 102*b* with the smaller inclination angle of the two depicted anode disk segments 102*a* and 102*b*

107 cone-shaped X-ray beam emitted by the anode target of said rotary anode disk 102 when being exposed to electron beam 105 or a pulsed sequence thereof, said X-ray beam having a field of view whose opening angle depends on the size of the inclination angle of rotary anode 102

108 rotary multi-target anode according to the second exemplary embodiment of the present invention whose geometrical form is given by a solid of revolution of a multi-segment structure comprising an arbitrary number of conical anode segments inclined by distinct inclination angles with respect to a plane normal to the rotational axis 109 of said rotary anode (Exemplarily depicted is a rotary anode with five conical anode segments, each having a distinct inclination angle.)

108*a* X-radiation emitting surface of a conical anode segment of rotary multi-target anode 108 (also referred to as "anode target")

108*b* X-radiation emitting surface of another conical anode segment of rotary multi-target anode 108 (also referred to as "another anode target")

109 rotational axis of rotary multi-target anode 108

110 combined focusing and deflection unit for focusing the electron beam 105 on the position of a focal spot (e.g. 111*a* or 111*b*) on an anode target (e.g. 108*a* or 108*b*) of rotary multi-target anode 108 and/or generating an electric and/or magnetic field for deflecting the electron beam 105 in radial direction of rotary multi-target anode 108

111*a* focal spot position on anode target 108*a* of rotary multi-target anode 108

111*b* focal spot position on anode target 108*b* of rotary multi-target anode 108 being of equal size as focal spot position 111*a* and all the other focal spot positions on the anode surface which may be exposed to an electron beam emitted by cathode 104

112*a* cone-shaped X-ray beam emitted by anode target 108*a* of rotary multi-target anode 108 when being exposed to electron beam 105, said X-ray beam having a field of view whose opening angle depends on the size of the inclination angle of the respective anode segment where the anode target 108*a* of rotary multi-target anode 108 is located

112*b* cone-shaped X-ray beam emitted by anode target 108*b* of rotary multi-target anode 108 when being exposed to electron beam 105, said X-ray beam having a field of view whose opening angle depends on the size of the inclination angle of the respective anode segment where the anode target 108*b* of rotary multi-target anode 108 is located

200 schematic diagram which illustrates the impact of the anode inclination angle α on the angular radiation field size β of an X-ray beam 107 emitted by the rotary anode disk 102 when being exposed to an electron beam 105 incident on an anode target's focal spot 106 on an X-radiation emitting surface 102' of said anode inclined with respect to a plane normal to the direction of the incident electron beam 105

300*a*+*b* two schematic diagrams which illustrate the impact of the rotary anode's inclination angle α on the angular size β of the obtained field of view, the width of the physical focal track and the achievable power rating α inclination angle of the rotary anode's X-radiation emitting surface 102'

β angular radiation field size of a cone-shaped X-ray beam 107 emitted by the anode target 102' of rotary anode disk 102

ν view angle under which said X-ray beam 107 can be detected

φ angle of rotation of rotary anode 102 when rotating about rotational axis 103*a*

ψ "reserve" angle of said view angle ν

The invention claimed is:

1. An X-ray tube of the rotary anode type comprising a rotatably supported essentially disk-shaped rotary anode with an anode target for emitting X-radiation when being exposed to an electron bean incident on a surface of said anode target, said rotary anode disk being divided into at least two anode disk segments with each of said anode disk segments having a conical surface inclined by a distinct acute angle with respect to a plane normal to the rotational axis of said rotary anode disk and thus having its own focal track width.

2. The X-ray tube according to claim 1, comprising a control unit for pulsing the electron beam selectively based on which disk segment, from among said at least two, a pulse created by said pulsing would impinge upon.

3. The X-ray tube according to claim 2, comprising a cathode, a rotation of said anode having more than one phase with respect to said cathode, said X-ray tube being configured for synchronizing said pulsing with said more than one phase.

4. The X-ray tube according to claim 1, wherein the rotary anode disk is divided into a number of anode disk segments of equal angular size.

5. The X-ray tube according to claim 1, comprising at least one focusing unit for focusing the electron beam on the position of a focal spot on the anode target of said X-ray tube's rotary anode disk and a focusing control unit for adjusting the focusing of the focal spot such that deviations in the focal spot size relative to a given nominal focal spot size are compensated.

6. The X-ray tube according to claim 1, comprising:

at least one deflection unit configured for generating an electric and/or magnetic field deflecting the electron beam in a radial direction of the rotary ode disk; and a deflection control unit configured for making an adjustment based on a given width of a circular focal track and based on a nominal focal spot position on said track, said width depending on said distinct acute angle of an anode disk segment, from among said segments, that has a current surface from among the conical surfaces that is currently being impinged upon by said electron beam, said making comprising adjusting a strength and/or algebraic sign of, respectively, the electric and/or magnetic field so as to compensate for deviations, relative to said nominal focal spot position, in a position of a focal spot on said current surface.

7. The X-ray tube according to claim 1, wherein said control unit is configured for pulsing the electron beam such that, depending on a size of a targeted region to be visualized, only the anode disk segment with the smallest possible inclination angle needed for completely irradiating said region is exposed to said electron beam.

8. An X-ray scanner system comprising an X-ray tube of the rotary anode type according to claim 1.

9. The X-ray tube of claim 2, said electron beam having a duty cycle, said selecting being based on a given angular range such that said cycle takes on its switched on state only when the electron beam is to impinge upon a disk segment, from among said at least two, whose said distinct acute angle is from said range.

10. The X-ray tube of claim 5, said focal spot having a length and a width, said tube configured for independently adjusting, in a continuous manner, said length and said width.

11. An X-ray tube of the rotary anode type comprising a rotatably supported multi-target anode for emitting X-radiation when being exposed to an electron beam incident on a surface of a respective one from a plurality of distinct anode targets, wherein said multi-target anode has a geometrical form which is given by a solid of revolution of a multi-segment structure comprising a number of conical anode segments inclined by distinct inclination angles with respect to a plane normal to the rotational axis of said rotary anode such that each anode target has its own focal track width and emits a fan X-ray beam with a field of view of its own size as given by the own angle of inclination of the conical anode segment and the opening angle of said X-ray beam.

12. The X-ray tube according to claim 11, comprising at least one focusing unit for focusing the electron beam on the position of a focal spot on anode target of said X-ray tube's rotary multi-target anode and a focusing control unit for adjusting the focusing of the focal spot such that deviations in the focal spot size relative to a given nominal focal spot size are compensated.

13. The X-ray tube according to claim 12, said width of said respective one being given, said tube comprising:

at least one deflection unit configured for generating an electric and/or magnetic field deflecting the electron beam in a radial direction of the rotary multi-target anode; and a deflection control unit configured for making an adjustment based on the given width and based on a nominal focal spot position on said track, said given width depending on the respective distinct inclination angle of said respective one from said plurality of distinct anode targets, said making comprising adjusting a strength and/or algebraic sign of, respectively, the electric and/or magnetic field so as to compensate for deviations, relative to said nominal focal spot position, in a position of a focal spot on said surface.

14. The X-ray tube according to claim 13, wherein the at least one focusing unit and the at least one deflection unit are realized as a combined multi-pole focusing and deflection electrode system and/or as a combined multi-pole focusing and deflection coil or magnet system, respectively.

15. An X-ray tube comprising:

a rotary anode having a rotational axis and comprising a plurality of target surfaces that are conically shaped with respect to said axis and inclined at respectively different angles to a plane normal to said axis, said tube configured for emitting a plurality of electron beams incident, at respective incident angles, to corresponding ones of said surfaces, said tube further configured such that at least two of said incident angles differ.

16. The X-ray tube of claim 15, configured for selectively issuing fan X-ray beams having correspondingly different opening angles, said tube further comprising:

a control unit configured for the selecting, said selecting comprising choosing, from among said corresponding ones of said surfaces, a surface for serving as a target for a current one of the plural electron beams.

17. The X-ray tube of claim 16, said choosing comprising picking, depending on a size of a region of interest to be currently visualized by X-rays, as said surface only a surface, from among said corresponding ones, with a smallest one of the inclination angles that would still serve to completely irradiate said region for the visualization.

18. The X-ray tube of claim 15, comprising:

a focusing unit configured for focusing a beam from among said plurality to create a focal spot on a corresponding one of said surfaces; and a focusing control unit configured for adjusting said focusing such that deviations in a size, of said focal spot, relative to a given nominal focal spot size are compensated.

19. The X-ray tube of claim 18, said focal spot having a length and a width, said tube configured for independently adjusting, in a continuous manner, said length and said width.

20. The X-ray tube of claim 15, comprising a cathode for said emitting and configured such that the difference causes each of the corresponding ones of said surfaces to have its own focal track width.

* * * * *